US005340210A

United States Patent [19]

Patel et al.

[11] Patent Number: 5,340,210

[45] Date of Patent: Aug. 23, 1994

[54] APPARATUS FOR BLENDING CHEMICALS WITH A REVERSIBLE MULTI-SPEED PUMP

[75] Inventors: Mayur Patel, Sugar Land; Michael T. Phillips, Houston; Gary L. Cooper, Missouri City; Daniel Emmons, Rosenberg, all of Tex.

[73] Assignee: Nalco Chemical Company, Naperville, Ill.

[21] Appl. No.: 841,977

[22] Filed: Feb. 25, 1992

[51] Int. Cl.[5] ..... B01F 15/02; B01F 15/04

[52] U.S. Cl. ..... 366/132; 366/141; 366/152; 366/159; 366/161; 366/168; 366/182

[58] Field of Search ..... 366/132, 134, 141, 151, 366/152, 159, 160–162, 168, 177, 182, 203, 261, 332; 137/567, 602, 896, 897

[56] References Cited

U.S. PATENT DOCUMENTS

| | | | |
|---|---|---|---|
| 2,945,445 | 7/1960 | Smith et al. | 137/567 X |
| 3,574,343 | 4/1971 | Cutler | 366/176 X |
| 3,608,869 | 9/1971 | Woodle | 366/132 |
| 3,868,715 | 2/1975 | Slavin | 366/166 X |
| 4,323,313 | 4/1982 | Oberg et al. | 366/160 X |
| 4,506,982 | 3/1985 | Smithers et al. | 366/160 X |
| 4,802,141 | 1/1989 | Stegemoeller et al. | 366/132 |
| 4,863,277 | 9/1989 | Neal et al. | 366/141 X |
| 4,886,367 | 12/1989 | Bragg et al. | 366/134 X |
| 5,145,250 | 9/1992 | Planck et al. | 366/152 X |

FOREIGN PATENT DOCUMENTS

| | | | |
|---|---|---|---|
| 2433433 | 5/1975 | Fed. Rep. of Germany | 366/152 |

OTHER PUBLICATIONS

Dowell Schlumberger; Precision Fracturing; Absolute Control Over Fracturing Operations; 1990.

*Primary Examiner*—Stephen F. Gerrity
*Assistant Examiner*—Charles Cooley
*Attorney, Agent, or Firm*—Arnold, White & Durkee

[57] ABSTRACT

An apparatus for mixing or blending chemicals includes a dedicated pump for each type of chemical to be blended, such as one pump for water-based chemicals and another pump for oil-based chemicals. Each pump preferably operates in a fast speed when delivering the majority of a particular chemical into a vending vat. When the desired amount of a chemical has almost been pumped into the vat, the pump switches to a slower speed to add the remaining amount. Then, the pump is reversed to clear the chemical from the line so that another similarly based chemical can be pumped through the line into the vat.

10 Claims, 13 Drawing Sheets

COM-TROL SCREEN LAYOUT

DATE: .....

COM-TROL DOCUMENTATION

SCREEN NUMBER #1 UNMARKED

NALCO MULTICHEM

INPUT:

OPERATOR ID:
POO:
SELECT RECIPE:
BATCH NUMBER:
ORDER NUMBER:
QTY REQUIRED (GAL):
BASE TANK SERIAL #:
BASE TANK TARE WT:
DISCHARGE TO PKGE CODE:

DATE:
TIME:

SCALE WEIGHT:
PROCESS SEC
START-UP SEC

F1-START F2-STOP F3-RESET F4-CHANGE SCREEN 1&0 CHECK CAL

Fig 13A

COM-TROL DOCMENTATION DATE: .....

SCREEN NUMBER # 2 UNMARKED

NALCO MULTICHEM RECIPES Pg 1

| # | PRODUCT | Pmp 1A | Pmp 1B | Pmp 1C | Pmp 2D | Pmp 2E | Pmp 2F | Pmp 3G | Pmp 3H | Dnst |
|---|---|---|---|---|---|---|---|---|---|---|
| 1 | ABCDE | INT. 1 | SOL. 1 | SOL. 2 | | | | | | 9.2 |
| 2 | ABCDF | | | | INT. 10 | SOL. 10 | SOL. 11 | | | 7.3 |
| 3 | ABCDG | | | | | | | INT. 20 | SOL. 21 | 8.2 |
| 4 | ABCDH | INT. 2 | SOL. 1 | SOL. 2 | | | | | | 7.4 |
| 5 | ABCDI | | | | INT. 11 | SOL. 10 | SOL. 11 | | | 8.4 |
| 6 | ABCDJ | | | | | | | INT. 21 | SOL. 21 | 8.0 |
| 7 | ABCDK | INT. 3 | SOL. 2 | SOL. 3 | | | | | | 7.6 |
| 8 | ABCDL | | | | INT. 12 | SOL. 13 | SOL. 15 | | | 7.4 |
| 9 | ABCDM | | | | | | | INT. 25 | SOL. 23 | 7.4 |
| 10 | ABCDN | INT. 3 | SOL. 2 | SOL. 3 | | | | | | 7.1 |
| 11 | ABCDO | INT. 4 | SOL. 1 | SOL. 3 | | | | | | 7.4 |
| 12 | ABCDP | INT. 4 | SOL. 8 | INT. 5 | | | | | | 7.3 |
| 13 | ABCDQ | | | | INT. 14 | SOL. 15 | INT. 10 | | | 7.3 |
| 14 | ABCDR | | | | INT. 16 | SOL. 10 | SOL. 16 | | | 8.3 |
| 15 | ABCDS | | | | | | | INT. 27 | SOL. 28 | 9.1 |
| 16 | ABCDT | SOL. 4 | INT. 6 | SOL. 1 | | | | | | 8.7 |
| 17 | ABCDU | SOL. 6 | INT. 1 | INT. 8 | | | | | | 7.7 |
| 18 | ABCDV | | | | SOL. 19 | INT. 18 | INT. 10 | | | 7.4 |
| 19 | ABCDW | | | | | | | SOL. 29 | INT. 22 | 8.5 |

Fig.13B

Fig. 15

316

| | A | B | C | D | E | F | G | H | I | J | K | L |
|---|---|---|---|---|---|---|---|---|---|---|---|---|
| 1 | | X | | | | | | | | | | |
| 2 | | X | | X | X | | | | | | | |
| 3 | X | O | X | X | X | | | | | | | |
| 4 | O | X | O | O | O | | | | | | | |
| 5 | O | X | O | X | | X | | | | | | |
| 6 | | X | O | O | O | O | O | O | O | O | | |
| 7 | | X | | X | | | | | | | | X |
| 8 | X | O | X | X | | | | | | | | X |
| 9 | O | X | O | O | | | | | | | | O |
| 10 | | X | | X | | | | | | | X | |
| 11 | X | O | X | X | | | | | | | X | |
| 12 | O | X | O | O | | | | | | | O | |
| 13 | O | X | O | O | O | O | O | O | O | O | O | O |

LEGEND: X = ENERGIZED

318

| | |
|---|---|
| A- | ON/OFF VALVE, 198 |
| B- | PILOT VALVE, 202 |
| C- | FLOW CONTROL VALVE, 200 |
| D- | DUMP VALVE, 182 |
| E- | 3-WAY VALVE, 212-DOWN |
| F- | 3-WAY VALVE, 212-UP |
| G- | 3-WAY VALVE, 214-DOWN |
| H- | 3-WAY VALVE, 214-UP |
| I- | 3-WAY VALVE, 216-DOWN |
| J- | 3-WAY VALVE, 216-UP |
| K- | VALVE, 218-DOWN |
| L- | MIXER VALVE, 220 |

Fig. 16

APPARATUS FOR BLENDING CHEMICALS WITH A REVERSIBLE MULTI-SPEED PUMP

BACKGROUND OF THE INVENTION

Field of the Invention

The present invention relates generally to a method and apparatus for mixing chemicals and, more particularly, to a small, preferably portable, system for mixing non-reactive chemicals.

Description of the Related Art

Many industries worldwide use chemicals to perform a wide variety of tasks. In fact, chemical consumers range from a typical homekeeper who purchases basic cleaning supplies to multi-national energy producers who require customized chemicals for the various stages of energy production. Historically, these larger chemical users have purchased chemicals in bulk. Thus, the chemical companies that supply these industries with chemicals have made the various chemical blends in large batches.

These larger chemical users often desire thousands of different blended chemicals. For example, oil refineries use custom-blended corrosion inhibitors in their processing plants to provide maximum corrosion protection for prolonging the life of the processing plants. Therefore, a chemical company may be required to stock hundreds of different intermediate chemicals, concentrates, or solvents, in order to produce these blended chemicals.

A typical device for blending chemicals includes a large vat capable of holding in excess of ten thousand pounds of chemicals. Large agitators are placed inside the vat to mix the chemicals that are added to the vat. A plurality of lines feed chemicals into the vat. One end of a line is coupled to the vat, and the other end of the line is coupled to a container holding a chemical to be added to the mix. Pumps, coupled to the lines, draw the chemicals through the lines from the containers to the vat. The amount of chemicals added to the vat is controlled by mass flow meters, which are connected to the lines, or by determining the weight of the chemicals added to the vat.

Once the large batch of chemicals has been thoroughly mixed in the vat, a sample is removed and taken to a laboratory for testing. The testing may vary depending on the type of blended chemical desired. However, typical testing may include measuring the density of the blended chemical or taking the FTIR fingerprint of the chemical. If the blended chemical passes the test, it is packaged into appropriate containers and shipped to the customer. If not, the blended chemical must be further tested to determine the percentages of the individual chemicals which comprise the blended chemical. Then, it must be determined how the blended chemical can be reworked in order to produce the desired blend. Finally, the proper amounts of additional chemicals must be added to the blend to achieve the desired blend. Once reworked, the blended chemical may be packaged and shipped to the customer.

After a particular chemical blend has been packaged, i.e., removed from the mixing vat, the entire mixing device must be cleaned out. The clean out procedure typically includes flushing the lines and rinsing the vat. Next, the device must be set up in order to mix a different blend. This set up procedure may include connecting different lines to the vat, connecting the appropriate measuring devices to the lines or the vat, and connecting the lines to the appropriate chemical containers. After set up, the device charges chemicals into the mixing vat one at a time. Typically, the charging is performed manually with operators viewing the measuring devices and controlling the flow of chemicals through manually-operated valves. After the charging has been completed, the agitators mix the chemicals in the vat, and the inspection process is repeated, as set forth above.

The method and device set forth above suffer from many problems. First, the vat and agitators used to make large batches cannot make small batches. A small batch will not immerse the agitators, and, thus, the agitators are rendered ineffective. Second, the mass flow meters used to monitor the amount of chemical being charged through the line are expensive. Furthermore, since the chemicals being charged may exhibit widely varying densities or viscosities, the flow meters tend to provide inaccurate information or to require frequent recalibration. Third, operators follow a written procedure to mix each batch. Thus, human error poses a continuous problem. Fourth, the required quality testing may add ten percent or more to the final cost of the blended chemical. Providing a laboratory and a staff of chemists requires significant overhead. Furthermore, the process often requires rework to prevent waste. Rework is not only expensive, but time consuming. Fifth, the fact that operators manually control the charging process inherently introduces undesirable inaccuracies. Although a skilled operator may minimize these inaccuracies, the use of human judgment and manual operation remains a problem. Finally, the cleaning of the device wastes chemicals. Moreover, the chemicals removed from the device during its cleaning require disposal. This disposal is already quite expensive, and is becoming even more expensive with the increasing amount of government regulation.

The present invention is directed to overcoming, or at least reducing the effects of, one or more of the problems set forth above.

SUMMARY OF THE INVENTION

The method and apparatus disclosed herein offer one or more of the following advantages over the prior art. The invention decreases manufacturing costs and eliminates operator error. Since the blended chemicals produced by the invention are statistically proven, little inspection is necessary. Furthermore, there are fewer incorrectly blended chemicals, so most rework is eliminated. Since the hydraulic pumps reverse, chemicals in the lines are returned to their respective containers, thus eliminating waste and the costs and hazards associated with the disposal of chemical waste.

The invention also decreases distribution costs. Since the agitator is adapted for mixing chemicals in a typical shipping vat, once the agitator is removed, the vat need only be sealed prior to shipping. The apparatus is small, and preferably portable, so that it may be located at various sites at relatively little expense in order to save freight costs. Moreover, since the invention is capable of mixing an average blend in less than an hour, typically using widely available intermediate chemicals, concentrates and solvents, warehouse, handling, and inventory management costs are greatly reduced.

BRIEF DESCRIPTION OF THE DRAWINGS

The foregoing and other advantages of the invention will become apparent upon reading the following detailed description and upon reference to the drawings in which:

FIGS. 13A and B illustrate display screens in accordance with the present invention;

FIG. 15 is a truth table that links the flowchart with the apparatus illustrated in FIG. 7; and FIG. 16 is a table that re-defines elements of FIG. 7 for the truth table of FIG. 15.

Figure 1:
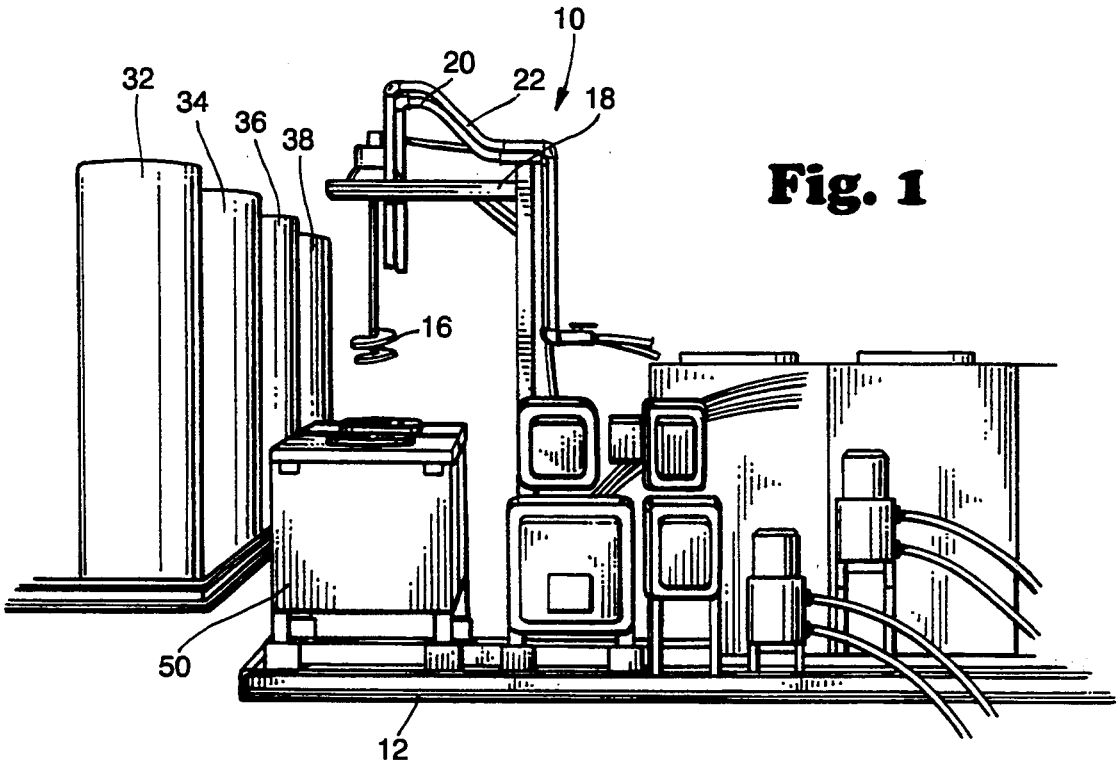
FIG. 1 illustrates an apparatus for blending chemicals, in a non-blending position, in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives following within the spirit and scope of the invention as defined by the appended claims.

DESCRIPTION OF THE PREFERRED EMBODIMENTS

Figure 2:
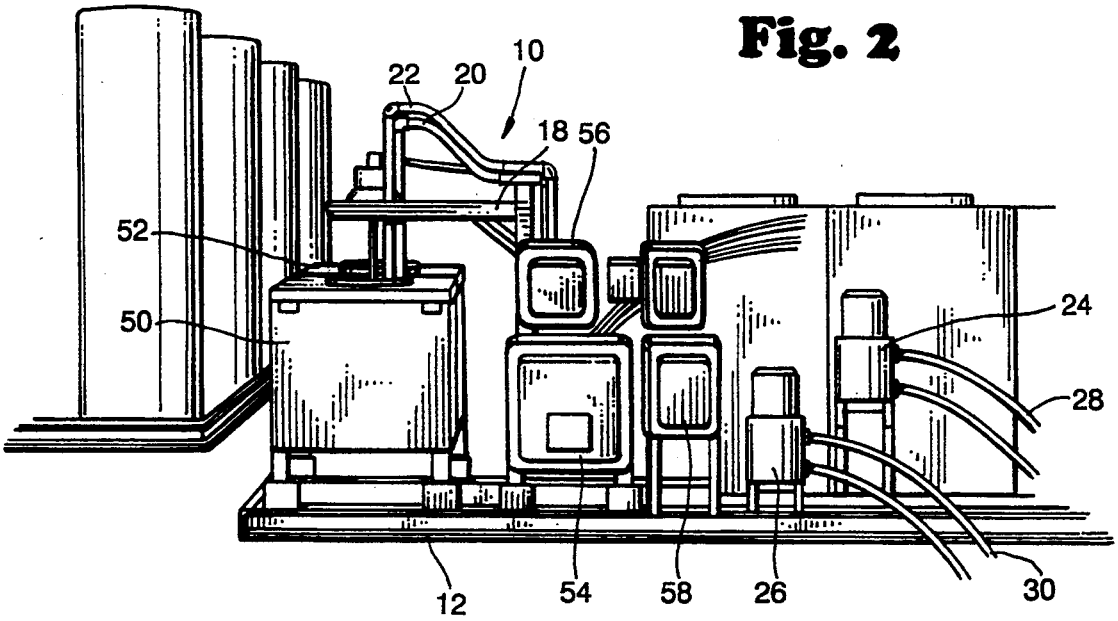
FIG. 2 illustrates the device of FIG. 1 in a blending position.
Figure 3:
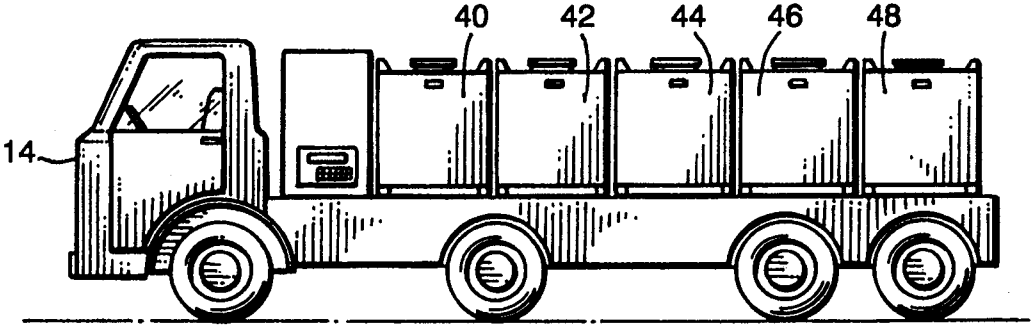
FIG. 3 illustrates a side view of a truck on which the apparatus illustrated in FIG. 1 may be carried in accordance with the present invention.

Turning now to the drawings and referring initially to FIGS. 1 and 2, an apparatus for blending chemicals is illustrated and generally designated by the reference numeral 10. The apparatus 10 may be directly mounted onto a vehicle, such as the truck 14 illustrated in FIG. 3. So mounted, the apparatus 10 may serve as a mobile chemical blending unit. However, the apparatus 10 is preferably mounted on a skid 12 to facilitate transportation of the apparatus 10, since the apparatus 10 and the skid 12 may be mounted onto the truck 14. While this too could serve as a mobile blending unit, the fact that the apparatus 10 is mounted on the skid 12 facilitates the removal of the apparatus 10 and skid 12 for placement in a desired plant location.

The apparatus 10 includes a blending auger 16 that is coupled to a moveable mast 18. The mast 18 is hydraulically controlled and moveable between an upper, non-blending position, as illustrated in FIG. 1, and a lower, blending position, as illustrated in FIG. 2. In addition to the auger 16, the mast 18 also carries two hoses 20 and 22. The hoses 20 and 22 are connected to respective charge pumps 24 and 26. Preferably, the hose 20 and the charge pump 24 are dedicated to water-based chemicals, and the hose 22 and charge pump 26 are dedicated to oil-based chemicals. In addition, another hose 25 and another pump 27 (shown in FIGS. 6 and 7) may be added as a spare or to be used with another class of chemicals, such as paraffin-based chemicals.

The hoses 28 and 30, connected to the other end of the charge pumps 24 and 26, respectively, deliver chemicals to the apparatus 10 from appropriate containers 32, 34, 36, and 38. It should be understood that the apparatus 10 is quite versatile in regard to its chemical supply. While the hoses 28 and 30 may be coupled to the large containers 32–38 in a warehouse or outdoor facility, the ends of the hoses 28 and 30 may also be immersed in smaller, portable containers 40, 42, 44, 46, or 48, which may be mounted on the truck 14 with the apparatus 10 or which may be otherwise available.

Regardless of where and how the chemicals to be mixed are stored, the charge pumps 24 and 26 draw them through the respective hoses 28 and 30 and deliver them into a vat 50 through the hoses 20 and 22, respectively. Preferably, the apparatus 10 uses two mixing vats 50 and 52, the vat 50 being used to mix water-based chemicals, and the vat 52 being used to mix oil-based chemicals. Although, as illustrated, the vats 50 and 52 sitting side by side are approximately the same width as the apparatus 10, an additional mixing vat (not shown) may be added for other types of chemicals, such as paraffin-based chemicals. In this situation, however, it may be preferable to use smaller mixing vats in order to limit the overall width of the apparatus 10. While this may not be a significant concern in warehouse operations, it is often desirable to limit the size of the apparatus 10 when it is mounted onto the vehicle 14.

The mast 18 that carries the blending auger 16 is preferably moveable between the vats 50 and 52. Therefore, the mast 18 not only moves the auger 16 in the vertical direction, but also horizontally. Of course, it may be desirable to operate the apparatus 10 in an assembly line. In this situation, the mixing vats would be serially fed through the apparatus 10. For instance, the vats may be placed on a conveyor that sequentially delivers an empty vat under the auger 16. After chemicals have been charged into the vat and blended, the auger 16 is raised so that the conveyor may move the vat of blended chemicals from beneath the auger 16 and replace it with another empty vat. In such an operation, the mast 18 would only be required to move the auger 16 vertically, not horizontally.

Preferably, the apparatus 10 operates under computer control. As illustrated in FIGS. 1 and 2, the apparatus 10 includes a computer 54, which is shown as being encased for protection, and an operator interface 56. Moreover, since the apparatus 10 is preferably adapted for use in either a warehouse or a portable environment, the apparatus 10 preferably includes a dual voltage system. As will be explained subsequently, the electrical components of the apparatus 10 preferably operate on 12 volt DC so that the battery on the truck 14 will power them. However, the apparatus 10 preferably includes a 240 volt AC to 12 volt DC converter 58 for warehouse applications.

Figure 5:
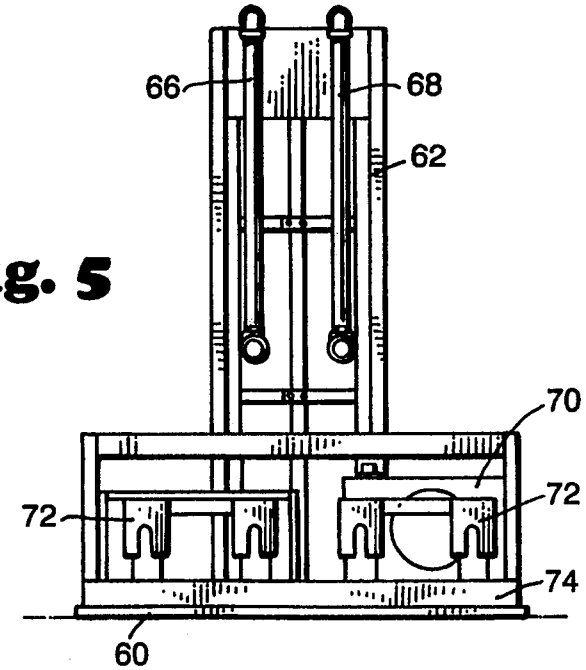
FIG. 5 illustrates an end view of the skid platform illustrated in FIG. 4.
Figure 4:
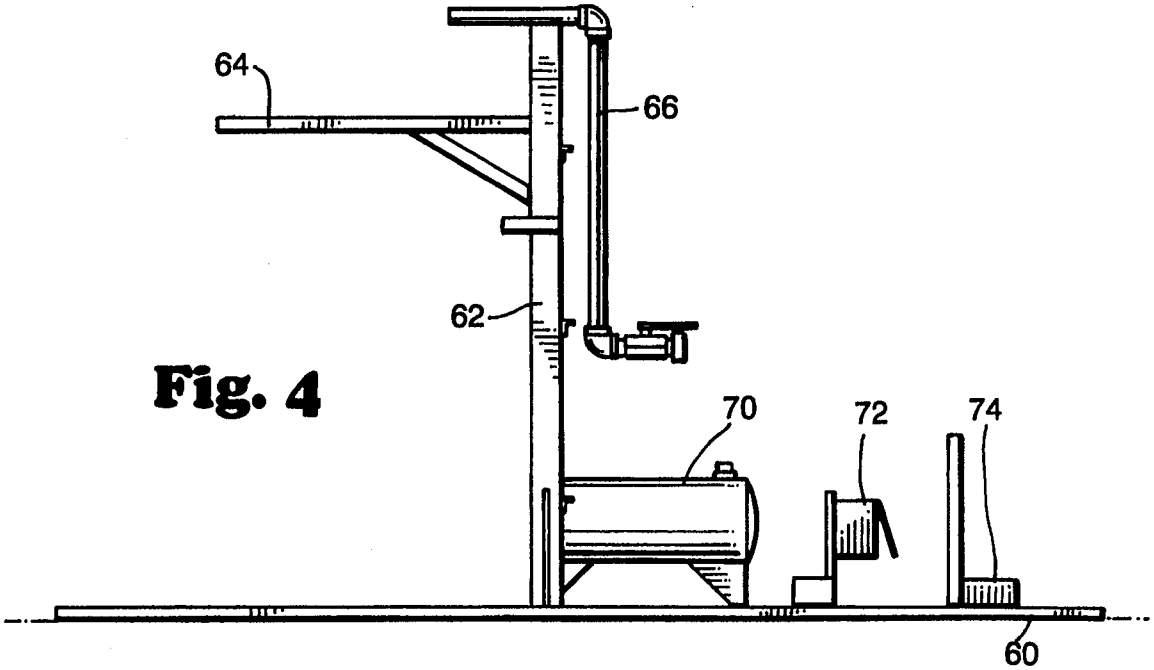
FIG. 4 illustrates a side view of a skid platform in accordance with the present invention.

As previously stated, the apparatus 10 is preferably skid-mounted to facilitate warehouse or portable applications. The preferred embodiment of the skid 12 is illustrated in FIGS. 4 and 5. The skid 12 includes a base 60 that is adapted to support the apparatus 10 in the warehouse or portable environments. Extending upward from and perpendicular to the base 60 is a mast support 62. At the upper end of the mast support 62 is a horizontally extending arm 64 which supports the auger 16. The mast support 62 also supports two pipes 66 and 68. The pipes 66 and 68 are coupled between the hoses 20 and 22, respectively, and the charge pumps 24 and 26, respectively. The skid is preferably 12 feet long, 5 ½ feet wide, and 8 feet high (with the mast 18 in its lowered position).

Figure 6:
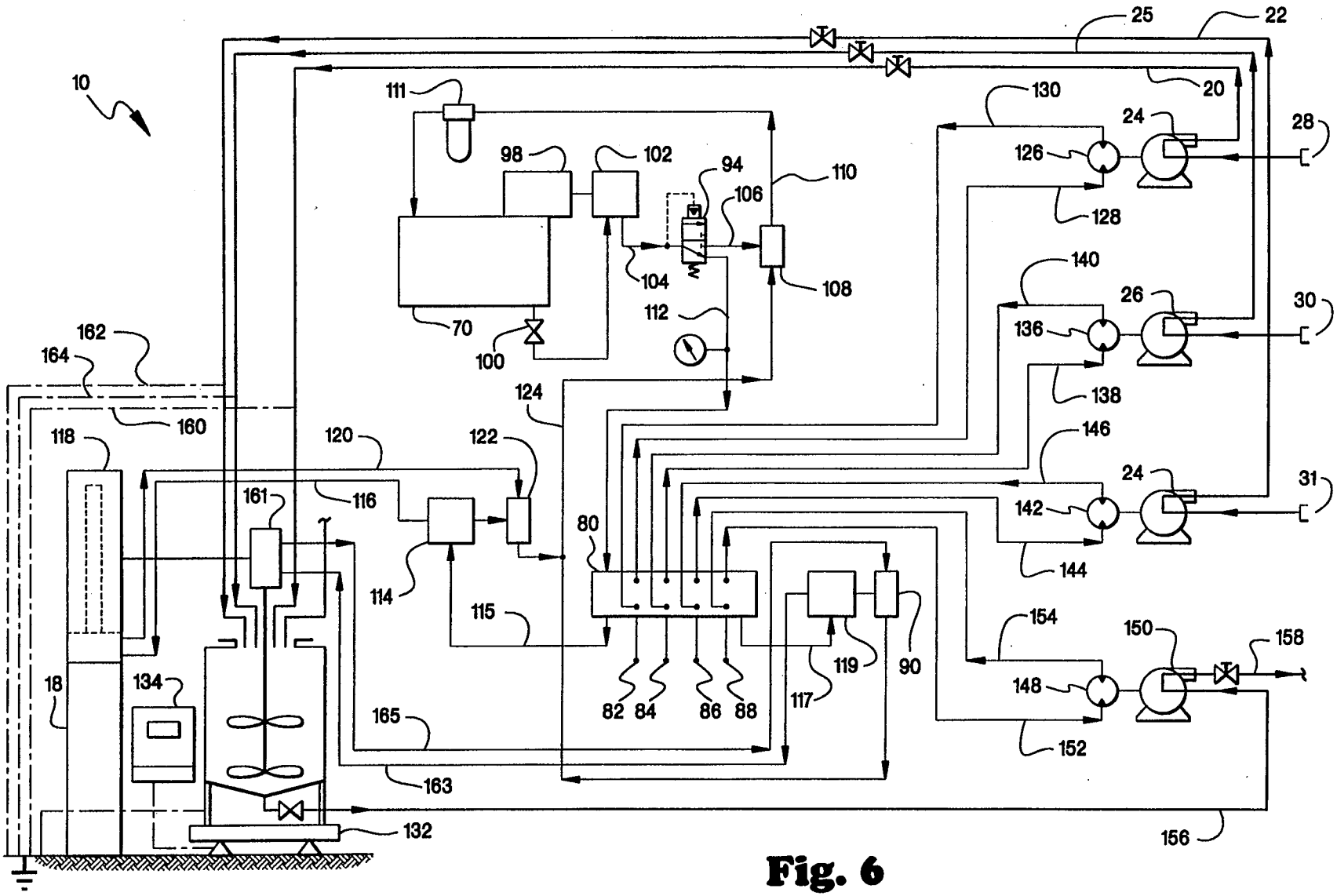
FIG. 6 is a schematic diagram of a manually operated chemical blending apparatus in accordance with the present invention.
Figure 7:
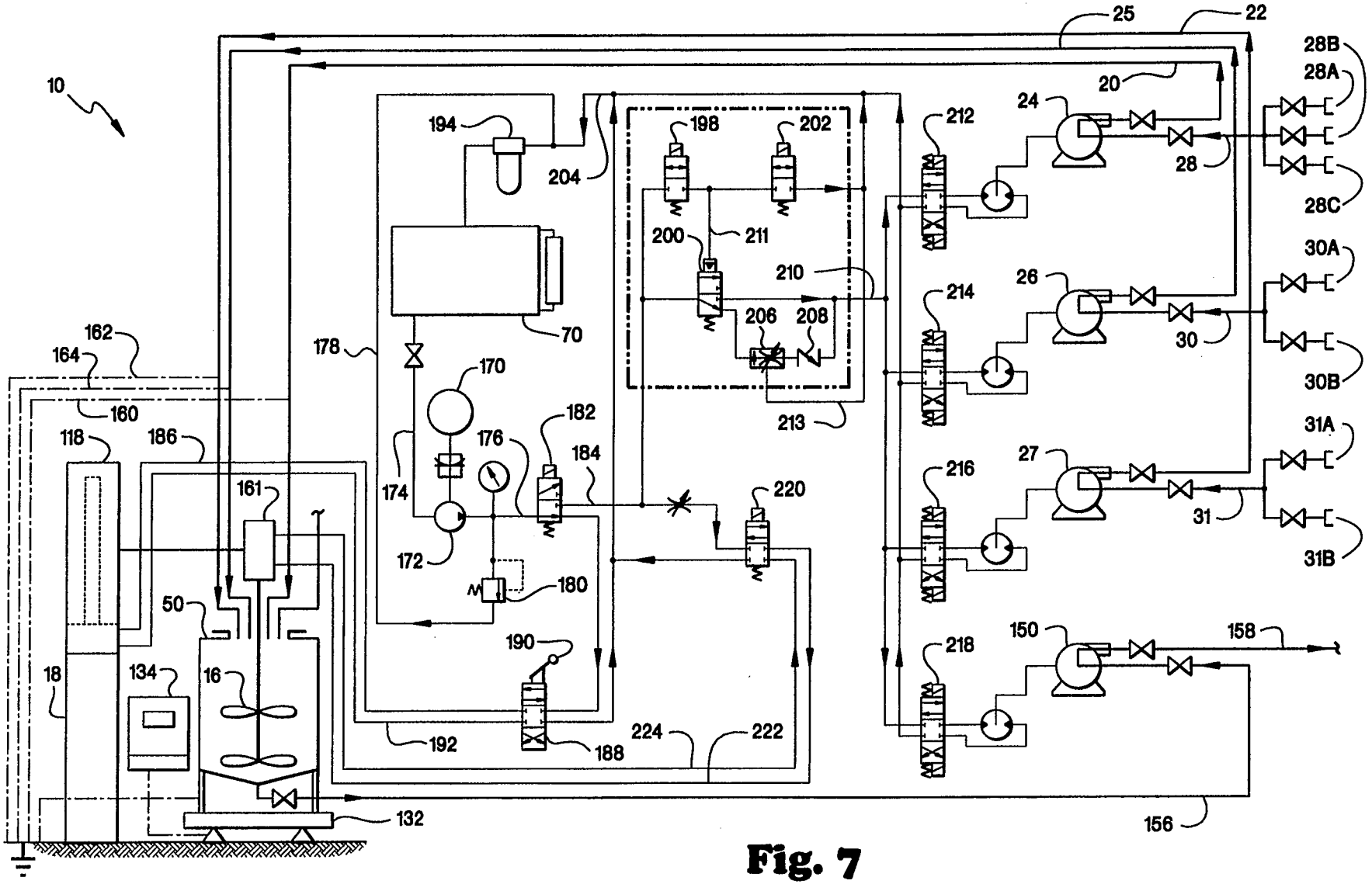
FIG. 7 is a schematic diagram of a computer-controlled apparatus for blending chemicals in accordance with the present invention.

Since hydraulics preferably operate the auger 16 and the mast 18, the base 60 also supports a hydraulic oil tank 70. The schematic diagrams illustrated in FIGS. 6 and 7 show how the tank 70 is coupled to the hydraulic system. A hydraulic motor support 72 and a pump support 74 are also carried by the base 60. The hydraulic motor support 72 couples the motor (98 or 170) associated with the tank 70 to the skid 12. The pump support 74 couples the charge pumps 24, 26, and 27 and the discharge pump 150 (see FIGS. 6 and 7) to the skid 12.

The apparatus 10 may be either manually operated or computer-controlled. Each offers advantages over the other. For instance, the manually operated apparatus 10, as schematically illustrated in FIG. 6, costs far less than the computer-controlled apparatus 10, illustrated schematically in FIG. 7. However, the computer-controlled apparatus 10 is still the most preferable embodiment due to the statistically high repeatability of its operation and of the blends produced. However, since both offer distinct advantages over the prior art, both of the embodiments of the apparatus 10 will be described herein.

FIG. 6 illustrates the manually operable embodiment of the apparatus 10. Hydraulic fluid is supplied to the apparatus 10 via the hydraulic oil tank 70. A motor 98 and pump 102 pump fluid from the tank 70 through a line 104 into a pressure relief valve 94. Preferably, the motor 98 is a 5 horsepower, 240 VAC, three-phase, electric motor that produces an operating pressure for the apparatus 10 of about 600 psi. If the pressure becomes too high, such as above about 1000 psi, fluid flows through a line 106 to a flow divider 108. The fluid then flows in return line 110, through a filter 111, back to the tank 70. Fluid flows to the rest of the apparatus 10 through the valve 94 on the line 112. The line 112 is coupled to a pump control valve 80, which preferably has two fluid outlets, which are connected to lines 115 and 117. Fluid flows through the line 115 into a manual control valve 114. Fluid exits the valve 114 on the line 116 and enters the hydraulic cylinder 118 of the mast 18. The fluid pressure causes the hydraulic cylinder 118 to extend and, thus, raise the mast 18. The fluid returns through the line 120 to a divider valve 122 and, then, returns to the divider valve 108 through the line 124. The valve 114 allows the fluid on line 116 to be manually controlled. Fluid not diverted into line 116 is diverted back to the divider 122. Thus, the mast may be raised or lowered using the manual control valve 114.

Initially, the mast 18 is raised so that the auger 16 rests above the vat 50 when chemicals are being charged into the vat 50. To charge chemicals from a first container (not shown) that is coupled to line 28, an operator actuates a control lever 82 on the pump control valve 80. The control lever 82 controls the hydraulic fluid flowing through a control valve 126 which is coupled to the charge pump 24. Fluid flows into and out of the valve 126 through lines 128 and 130, respectively. The chemicals are pumped by the charge pump 24 through the line 20 and into the vat 50.

The vat 50 rests on a load cell 132, such as a commercially available load cell produced by Pennsylvania Scale Co. The load cell 132 includes a display 134, which is preferably calibrated to display the weight of the chemicals in the vat 50. In other words, the display is calibrated so that the weight of the vat 50 is subtracted from the total weight on the load cell 132. Preferably, the load cell 132 is calibrated by placing a known weight on the cell and determining whether the display 134 accurately displays the proper weight. Preferably, the load cell 132 is designed to display weights up to 5000 pounds. However, the apparatus 10 is designed to operate where the total weight on the load cell 132 never exceeds 2500 pounds. It has been found that testing the low end of this range using a 50 pound known weight will properly calibrate the load cell 132. In other words, if the load cell 132 is accurate in its lower range, it is accurate in its upper range also.

The signals from the load cell 132 are preferably filtered so that the weight displayed on the display 134 does not fluctuate wildly. It will be appreciated that the display 134 could not otherwise display the accurate weight of the chemicals in the vat 50, because the chemicals falling into the vat 50 and splashing around tends to obscure the determination of the actual weight. The filter, therefore, filters out fluctuations produced as the chemicals fall into the vat 50, so that the signal displayed on the display 134 provides a more accurate indication of the actual weight of chemicals in the vat 50. One particular filter suited for this purpose is the HI2151/20 weight controller with "Waversaver" filtering available from Hardy Instruments of 9440 Carol Park Drive, San Diego, California.

The operator views the display 134 and controls the chemicals being charged into the vat 50 by carefully actuating the control lever 82. Precise operator control is particularly important when the amount of the chemical being charged into the vat 50 approaches the desired amount. Once the desired amount of chemical has been charged into the vat 50, the operator actuates the control lever 82 to reverse the charge pump 24. The charge pump 24 pumps the chemicals back through the line 20 and back into the container through the line 28. Thus, the line 20 is automatically cleaned out, without any waste of chemicals, so that the line 28 can be attached to another container of chemicals to be charged into the vat 50.

As previously mentioned, each charge pump 24, 26, and 27 is preferably dedicated to a particular type of chemical. Thus, if the second chemical to be charged into the vat 50 is incompatible with the particular type of chemical dedicated to the charge pump 24, the charge pump 26 or 27 is used. The operation of these charge pumps 26 and 27 is virtually identical to the operation of the charge pump 24 as just described. The control lever 84 controls the hydraulic fluid flow to valve 136 via lines 138 and 140. The valve 136 controls the speed and direction of charge pump 26. Therefore, the line 30 can be connected to a container (not shown), and charge pump 26 will pump chemicals from the container, through line 30, through line 22, and into the vat 50. Once the charging is complete, the operator may actuate control lever 84 to reverse the charge pump 26 so that chemicals in the line 22 will be pumped back through line 30 and into the container. Similarly, the control lever 86 controls the fluid flow through the valve 142 via lines 144 and 146. The line 31 is connected to a container (not shown), and the charge pump 27 pumps chemicals from the container through line 31, through line 25 and into the vat 50. Like the charge pumps 24 and 26, the pump 27 may be reversed using the control lever 86, so that chemicals in the line 25 are pumped back through line 31 and into the container.

It should also be noticed that the lines 20, 22, and 25, which deliver chemicals to the vat 50, are grounded via lines 160, 162, and 164, respectively. The chemicals pumped through the lines 20, 22, and 25 may carry electrostatic charges. Therefore, it is desirable to provide a ground path or each of the lines 20, 22, or 25 to dissipate these charges. As will be subsequently described, the apparatus 10 may be automatically shut off if one of the ground lines 160, 162 or 164 fails.

Once the necessary chemicals have been charged into the vat 50, the control levers 82, 84, 86 and 88 are returned to their neutral positions, and the mast 18 is lowered to place the auger 16 in the vat 50. Fluid may now flow through the outlet line 117 to the manual control valve 119. Fluid exits the valve 119 on the line 163 and enters the mixer motor 161. The fluid pressure causes the mixer motor 161 to rotate the auger 16. The fluid returns through the line 165 to a divider valve 90 and, then, returns to the divider valve 108 through the line 124. The valve 119 allows the fluid on line 163 to be manually controlled. Fluid not diverted into line 163 is diverted back to the divider 90. Thus, the auger 16 may be controlled using the manual control valve 119.

Finally, the control lever 88 controls fluid flow through a valve 148 that is coupled to a discharge pump 150. Fluid is delivered to and received from the valve 148 via lines 152 and 154, respectively. As illustrated, a line 156 couples the discharge pump 150 to a lower portion of the vat 50. Thus, after the chemicals in the vat 50 have been mixed, the operator may actuate the discharge pump 150 to remove chemicals from the vat, and deliver the chemical, via line 158, to an appropriate container. Alternatively, if the vat 50 is the shipping container for the blended chemical, it is removed, sealed, and shipped. Then, another empty vat 50 is placed under the auger 16.

It is important to note that the control of the entire apparatus 10 is centered about the pump control valve 80. When any of the pumps are in use, the outlet lines 115 and 117 receive virtually no fluid pressure. Therefore, the mast 18 and the auger 16 are effectively disabled while chemicals are being charged into the vat 50.

FIG. 7 illustrates the computer-controlled embodiment of the apparatus 10. Similar elements will usually be numbered using the same reference numerals found in the previously discussed figures. Unlike the manually operable embodiment illustrated in FIG. 6, the computer-controlled embodiment illustrated in FIG. 7 requires very little operator interaction. However, before discussing the computer control, the hydraulic circuit and chemical delivery circuit used with the computer control will be discussed with reference to FIG. 7.

Hydraulic fluid is supplied to the apparatus 10 via the hydraulic oil tank 70. A motor 170 drives a pump 172, which is coupled to the tank 70 via line 174. The pump 172 delivers fluid to the apparatus 10 via line 176. A return line 178, which includes a pressure relief valve 180, returns fluid to the tank 70.

An on\off solenoid dump valve 182 delivers hydraulic fluid to the rest of the circuit via lines 184 or 186. As illustrated, in its de-energized state, the solenoid dump valve 182 delivers fluid to the mast control valve 188 via line 186. To raise the mast 18, the control lever 190 of the mast control valve 188 is actuated to produce hydraulic fluid flow through line 186 to the hydraulic cylinder 118. Fluid returns to the valve 188 through line 192 and to the tank 70 through a filter 194. To lower the mast 18, the control lever 190 is actuated to provide a cross flow between lines 186 and 192. This reverses the flow of hydraulic fluid in the lines 186 and 192, thus lowering the mast 18 by retracting the hydraulic cylinder 118.

When the solenoid dump valve 182 is energized, hydraulic fluid is diverted away from the mast control valve 182 and delivered to a two-speed circuit 196. The two speed circuit 196 delivers hydraulic fluid via line 210 to the charge pumps 24, 26, and 27 and to the discharge pump 150. The two speed circuit 196 adjusts the flow of hydraulic fluid to these pumps so that the pumps may operate at a high speed when a large quantity of chemical is left to be charged or discharged, and at a slow speed when the amount of chemical to be charged or discharged approaches the desired amount.

The two-speed circuit 196 includes an on--off solenoid valve 198 connected in parallel with a flow control solenoid valve 200. A pressure release pilot valve 202 is connected in series with the on-off solenoid valve 198. A metering valve 206 and a check valve 208 are also connected in parallel with the flow control valve 200. When the pilot valve 202 is energized, the two-speed circuit 196 operates the selected pump in its "fast" mode. Fluid flows through the flow control valve 200 on the line 210 to the pumps. Any excess fluid is diverted through the line 211 to the energized pilot valve 202, which diverts the fluid to the return line 204. When the pilot valve 202 is de-energized and the on\off valve 198 and the flow control valve 200 are energized, the two-speed circuit 196 operates the selected pump in its "slow" mode. Fluid flows through the on\off valve 198, through line 211, to the flow control valve 200. Fluid flows through the flow control valve 200 on the line 210 and through the metering valve 206 on the return line 213. Due to the metering valve 206, a portion of the fluid, rather than being delivered to the pumps, returns to the tank 70. This reduced flow slows the rate at which the pumps turn, and, thus, slows the rate at which the pumps pump chemicals to or from the vat 50.

The valve 206 is preferably a metering valve so that an operator or engineer can manually calibrate the flow of hydraulic fluid delivered on line 210 when the two-speed circuit 196 is in the "slow" mode. Preferably, the pumps operate at about 50 gallons/minute in the "fast" mode, and at a preselected percentage (or ratio) of that rate in the "slow" mode. In the preferred embodiment, the ratio is about 3:1, so the pumps operate at about 16.7 gallons/minute in the "slow" mode. However, this ratio can be altered using the metering valve 206 from 1:1, by turning the valve 206 off, to almost any reasonable desired ratio.

The charge pumps 24, 26, and 27 and the discharge pump 150 operate essentially as described in FIG. 6. However, instead of being controlled by manually-operated valves, the pumps 24, 26, 27, and 150 are controlled by respective three-position solenoid valves 212, 214, 216, and 218. As illustrated, the valves 212, 214, 216, and 218 are normally closed when de-energized to prevent fluid flow to the respective pumps. To operate one of the charge pumps 24, 26, or 27 in a "forward" direction to pump chemicals from a respective line 28, 30, or 31 through a respective line 20, 22, or 25 and into the vat 50, the appropriate solenoid valve 212, 214, or 216 is actuated into its "down" position to provide a normal flow path through the respective charge pump 24, 26, or 27. The fluid flow from the line 210 to the actuated charge pump 24, 26, or 27 determines the rate of pumping, as previously described. At the appropriate time, as will be discussed later, the energized valve 212, 214, or 216 is de-energized into its "off" position to complete the charging cycle. Once the charging is complete, the valve 212, 214, or 216 is energized into its "up" position to provide a cross flow through its respective charge pump 24, 26, or 27. This cross flow causes the pump to operate in reverse and pump the chemical back through the respective line 20, 22, or 25, through the line 28, 30, or 31, and into the container from which it came.

Once all of the desired chemicals have been charged into the vat 50, an operator actuates the control lever 190 of the mast control valve 188 to lower the auger 16 into the vat 50. Then, an on-off solenoid valve 220 is energized to provide fluid flow to the mixer motor 161 via lines 222 and 224. When the mixing is complete, the on-off solenoid valve 220 is de-energized to stop the mixer motor 161. Then, an operator may actuate the control lever 190 to raise the auger 16 from the vat, so that the chemicals may be discharged using the discharge pump 150, or so that the vat 50 can be removed and replaced with another vat.

The discharge pump 150 and its associated solenoid valve 218 operate in much the same way as the charge pumps and their associated valves, described above. However, although valve 218 is illustrated as a three-position solenoid valve, an on-off solenoid valve is typically all that is needed. When the solenoid valve 218 is energized into its "on," or "down", position, the discharge pump 150 operates to pump mixed chemicals from the vat 150, through line 156, and out to a container via line 158. Because there is typically no reason to operate the discharge pump 150 in reverse to add chemicals to the vat 50 throuqh line 156, the valve 218 is rarely energized into its "up" position to provide a cross flow that would reverse pump 150.

Figure 8:
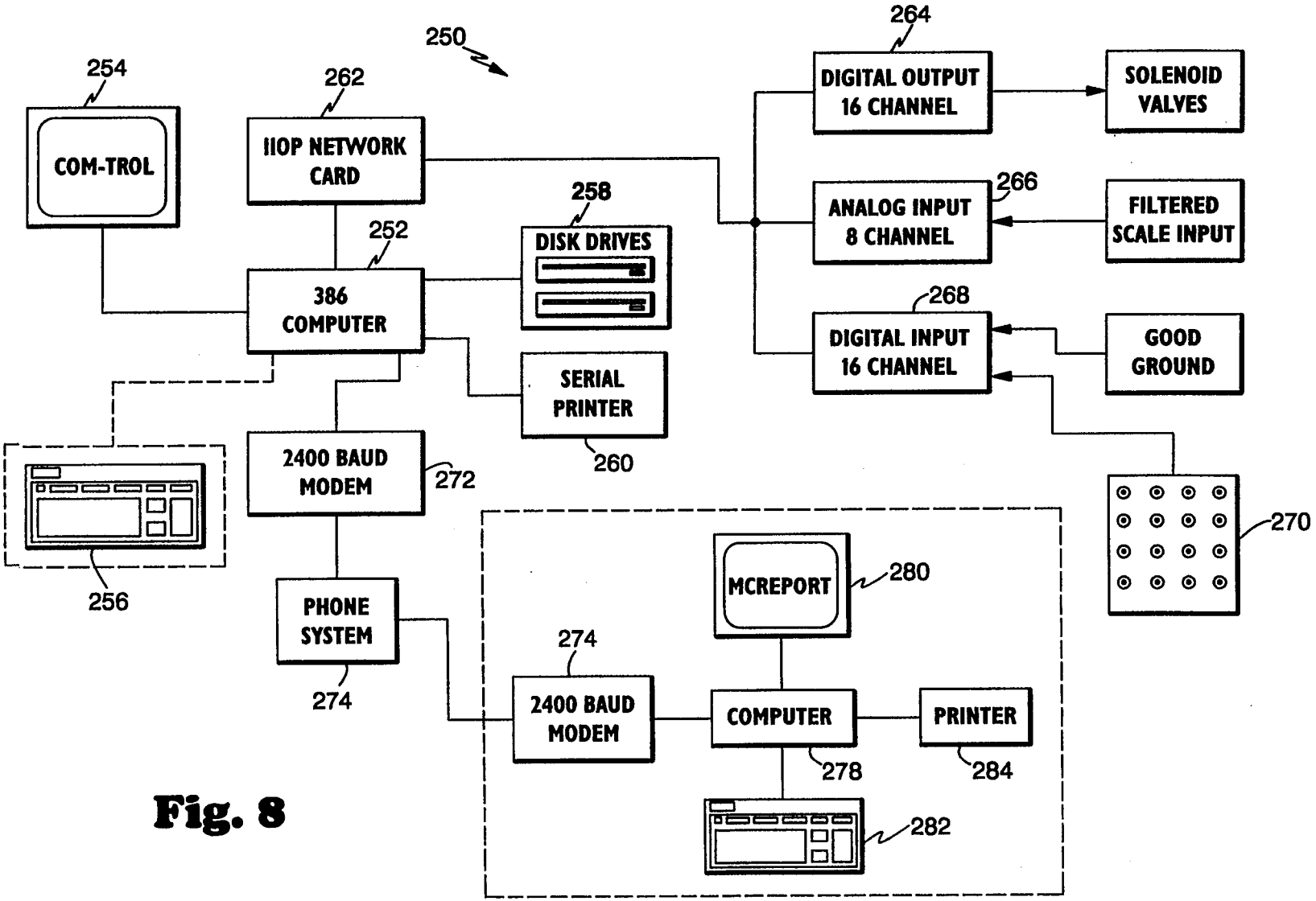
FIG. 8 is a block diagram illustrating the computer controlled device for controlling the apparatus illustrated in FIG. 7.

FIG. 8 illustrates the computer-based device, generally illustrated by the reference numeral 250, that controls the apparatus 10 illustrated in FIG. 7. It should be understood that the device 250 is only a preferred embodiment and that many other computer-based devices could control a blending apparatus such as that illustrated in FIG. 7. The device 250 includes a computer 252, which is preferably a 386-based personal computer. The computer 252 is coupled to a monitor 254, a key board 256, disc drives 258, and a serial printer 260. These peripherals are conveniently used to facilitate operator interface and to further automate functions collateral to the blending of chemicals, such as automatically printing a bill.

An IIOP network card 262 is also coupled to the computer 252. The computer 252 uses the network card 262 to interface with the apparatus 10. As illustrated, a digital output 264, preferably having 16 output channels delivers signals from the computer 252 to the solenoid valves described in FIG. 7. The computer 252 also receives information from the apparatus 10 via an analog input 266, preferably having 8 channels, and from a digital input 268, preferably having 16 channels The analog input 266 receives an analog signal from the load cell 132, converts the analog signal into a digital signal, and delivers the corresponding digital signal to the computer 252. The digital input 268 receives a digital signal from the ground lines 160, 162, and 164. As long as these lines are grounded, a binary "0" is delivered to the computer 252. However, if one of these lines becomes ungrounded for any reason, the digital input 268 receives a higher voltage corresponding to a binary "1." The digital input 268 also receives digital signals from a keypad 270, which an operator uses to control the apparatus 10 with the device 250.

The computer 252 is preferably coupled to a modem 272. The modem communicates via a telephone system 274 with another modem 276 at a remote location. The modem 276 is coupled to another computer 278, such as a personal computer, at the remote location. The remote computer 278 also includes a monitor 280, a keyboard 282, and a printer 284. In the most preferred embodiment, the remote computer 278 is loaded with software that allows an engineer at a remote location to control the computer 252. This control preferably includes the ability to view the contents of the monitor 254, download batch reports from the computer 252 to the remote computer 278, change the programming of the computer 252, run diagnostics on the blending system, and, generally, to fully control the system.

Although there are many remote control computer packages that may be used, a package called PCANYWHERE, and its companion package ATERM, are preferred. The computer 252 is loaded with PCANYWHERE when it is first booted. This software initializes the modem 272. Once loaded, PCANYWHERE runs in the background and is invisible to the computer operator. It will automatically answer if it is called by the modem 276. The companion package ATERM is similarly loaded on the remote computer 278. When the computer 252 is called by the computer 278, the contents of the monitor 254 appear on the monitor 280 and allow the remote operator to view the operator of the local system or to control the local system.

Figure 9:
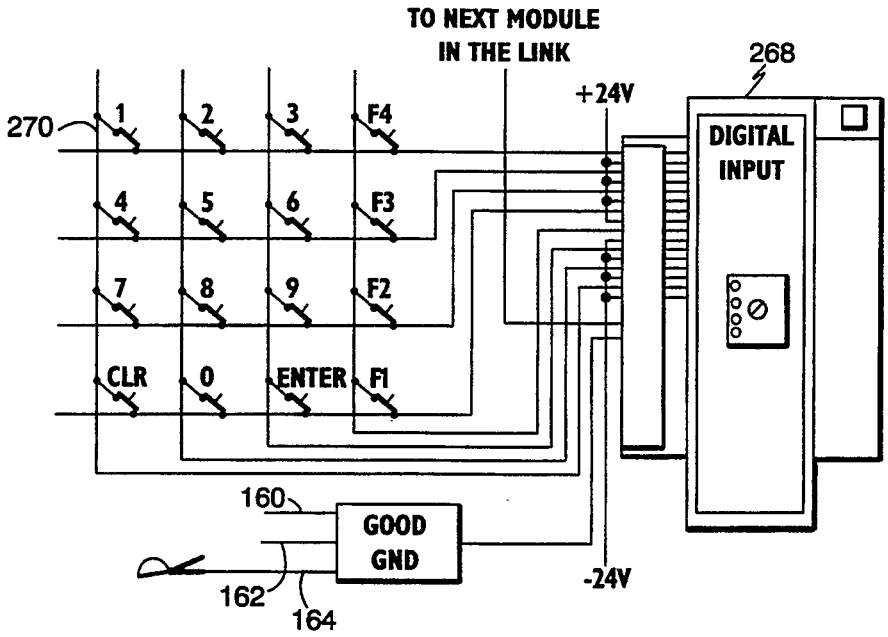
FIG. 9 is a schematic diagram illustrating the key pad and digital input of the device illustrated in FIG. 8.

Some of the elements of the device 250 are illustrated in greater detail in FIGS. 9–13. FIG. 9 illustrates the digital input 286 and its specific connections to the keypad 270 and to the ground lines 160, 162, and 164. The digital input 286 is preferably a model DIXX discreet input module available from Transition Technology, Inc. of Amesbury, Massachusetts.

Figure 10:
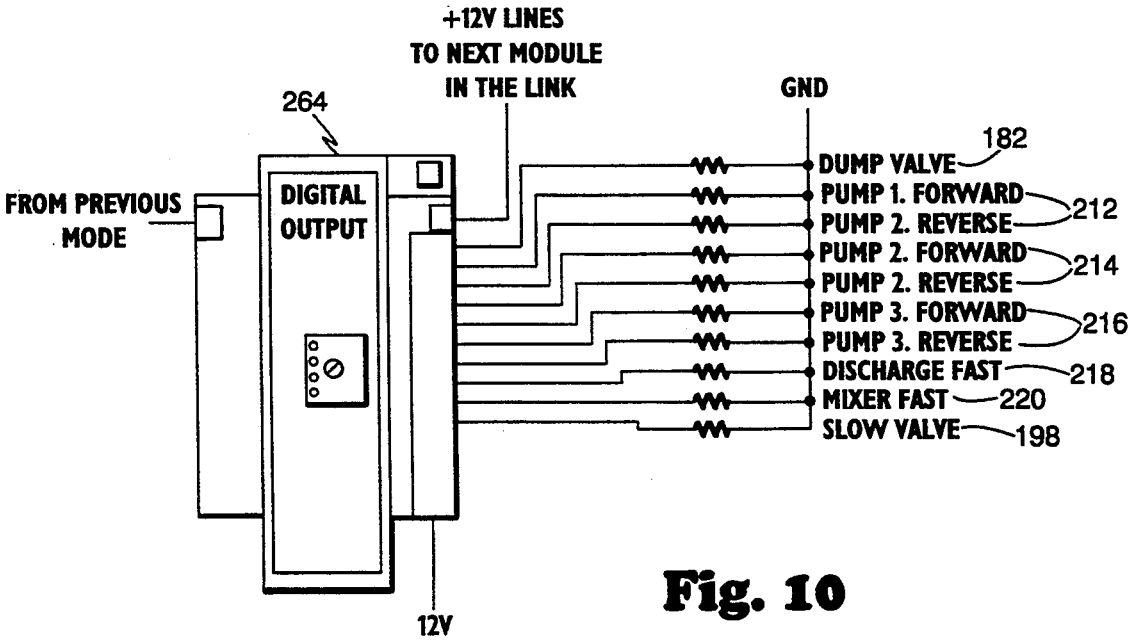
FIG. 10 is a schematic diagram illustrating the digital output of the device illustrated in FIG. 8.

FIG. 10 illustrates the digital output 264 and its specific connections to: the solenoid dump valve 182, the three-position solenoid valves 212, 214, and 216 (for both forward and reverse pump directions), the valve 218, the mixer valve 220, and the on-off valve 198. The digital output 264 is preferably a model DOXX discreet output module available from Transition Technology, Inc.

Figure 11:
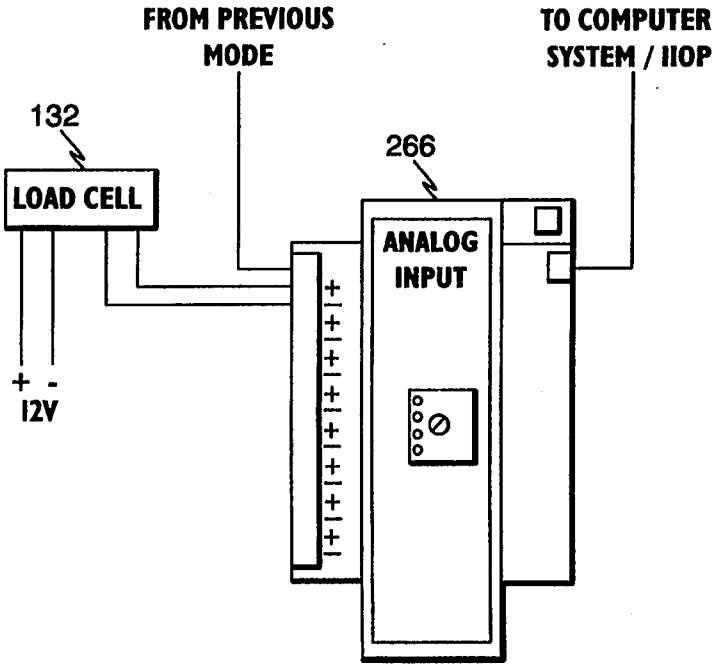
FIG. 11 is a schematic diagram illustrating a load cell coupled to the analog input of the device illustrated in FIG. 8.

FIG. 11 illustrates the analog input 266 and its connection to the load cell 132. The analog input 266 is preferably a model AIXX analog input module available from Transition Technology, Inc. Furthermore, this module is also preferably equipped with an auto-zero chip, also available from Transition Technology, Inc., which sets the output of the load cell 132 to zero at the beginning and end of each cycle.

Figure 12:
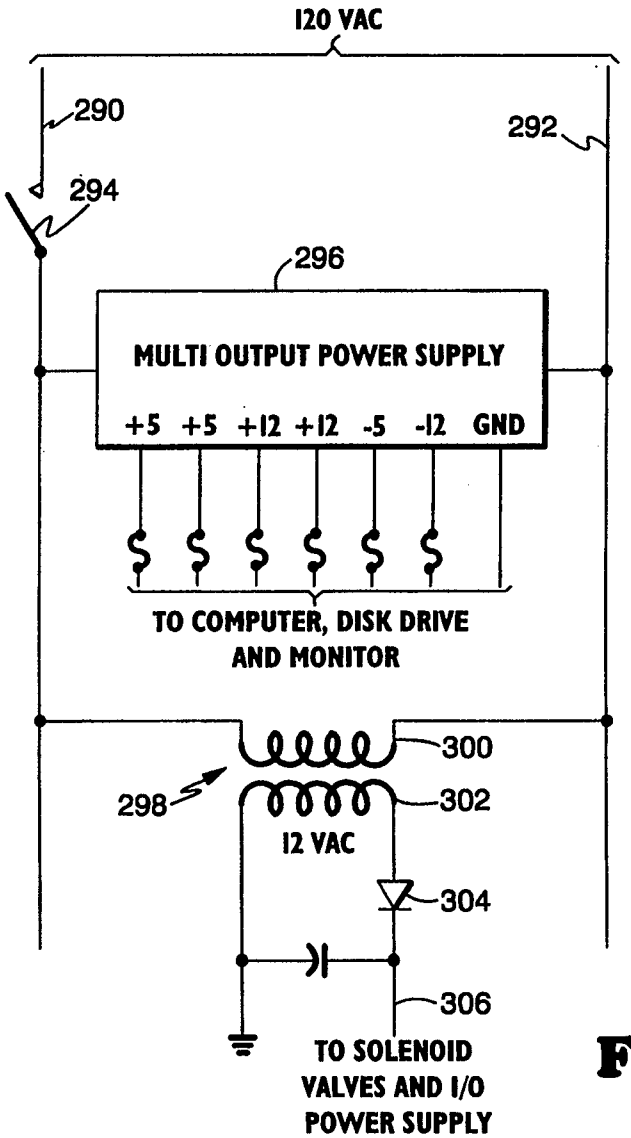
FIG. 12 illustrates the power supply for the computer-controlled apparatus.

FIG. 12 illustrates the power supply used with the device 250 and the apparatus 10, collectively referred to hereinafter as the "system." The lines 290 and 292 are connected to a voltage source generating 240 volts AC. A switch 294 is provided to disconnect the power supply from this voltage source. The power supply includes a regulated supply 296 that preferably outputs DC voltages of −5, +12, −5, and −12 volts. These regulated voltages are fed to the computer 252, the disc drives 258, the monitor 254, and other portions of the device 250 that require these types of regulated voltages. The power supply further includes a rectified transformer 298. The primary coil 300 of the transformer 298 is coupled between the lines 290 and 292. The secondary coil 302 of the transformer 298 converts the 240 volts AC to 12 volts AC and delivers this voltage through a rectifying diode 304. The rectified voltage is delivered, under the control of the computer 252, on line 306 to the solenoid valves.

FIGS. 13A and B illustrate two types of screens that preferably appear on the monitor 254. The first screen 305, as illustrated in FIG. 13A, allows the operator to enter the listed information to begin the processing of a blended chemical. If the operator does not know the proper recipe number, screens such as the screen 307, as illustrated in FIG. 13B may be accessed. As illustrated, the screen 307 lists the recipes by number, with each recipe having a product name, and a list of ingredients and the respective pumps.

FIGS. 14 and 17–20 illustrate flowcharts that describe the operation of the system. FIGS. 15 and 16 are tables that indicate the states of the various devices illustrated in FIG. 7 at different stages in the operation described in the flowcharts. The flowcharts illustrated in FIGS. 14 and 17 include encircled numbers next to particular blocks. These numbers correspond to the numbers listed in sequence on the left side of the truth table 316 of FIG. 15. The table 318 of FIG. 16 lists the various devices described in FIG. 7 that are affected by the operation described in these flowcharts. So that these devices can be easily listed in the truth table 316, they are essentially redefined using letters "A" through "L" in FIG. 16. The letter "X" in FIG. 15 indicates that the particular device listed in Table 318 is energized, and the letter "O" in a particular box of Table 318 indicates that the device listed in truth table 316 is de-energized.

Figure 14:
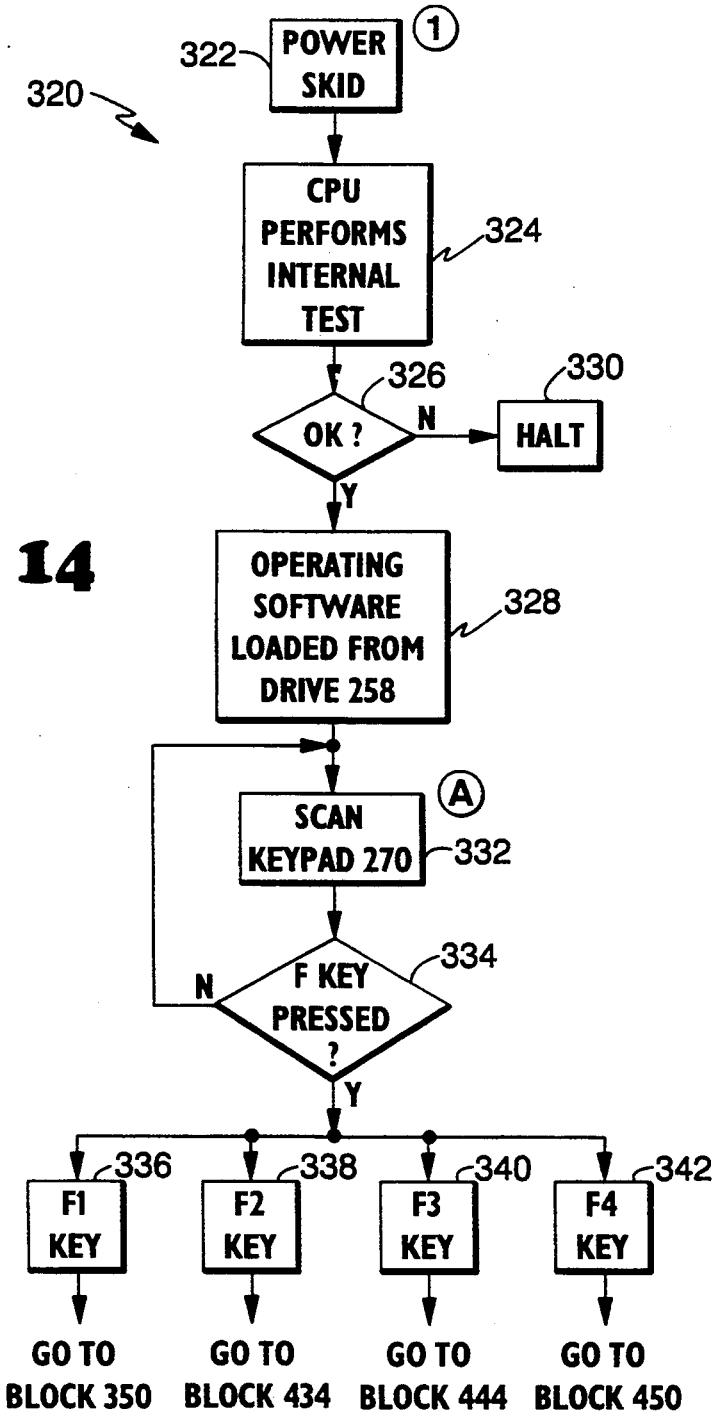
FIG. 14 illustrates a first portion of a flowchart describing the operation of the blending system.
Figure 17A:
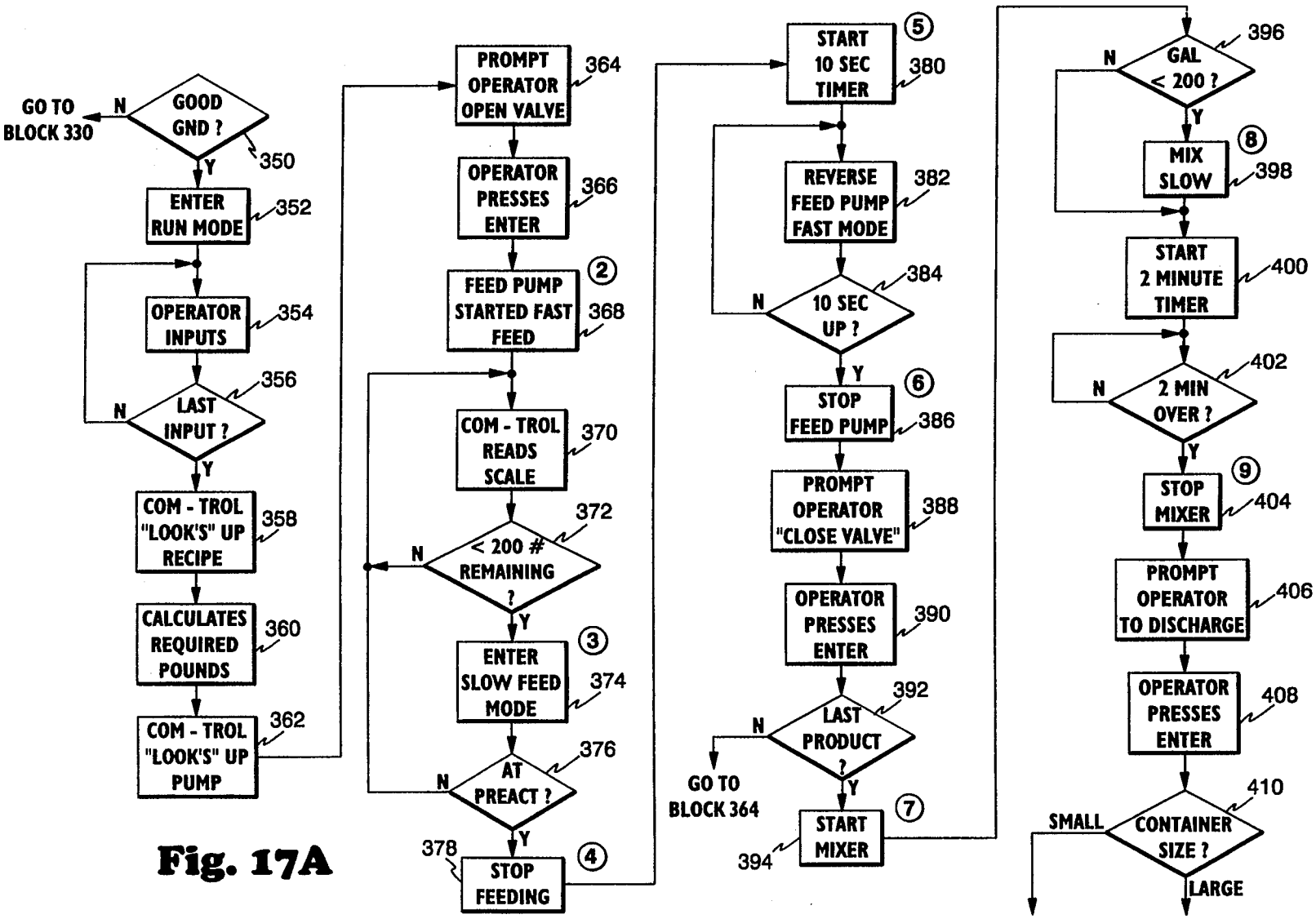
FIG. 17A illustrates a second portion of the flowchart describing the operation of the blending system.
Figure 17B:
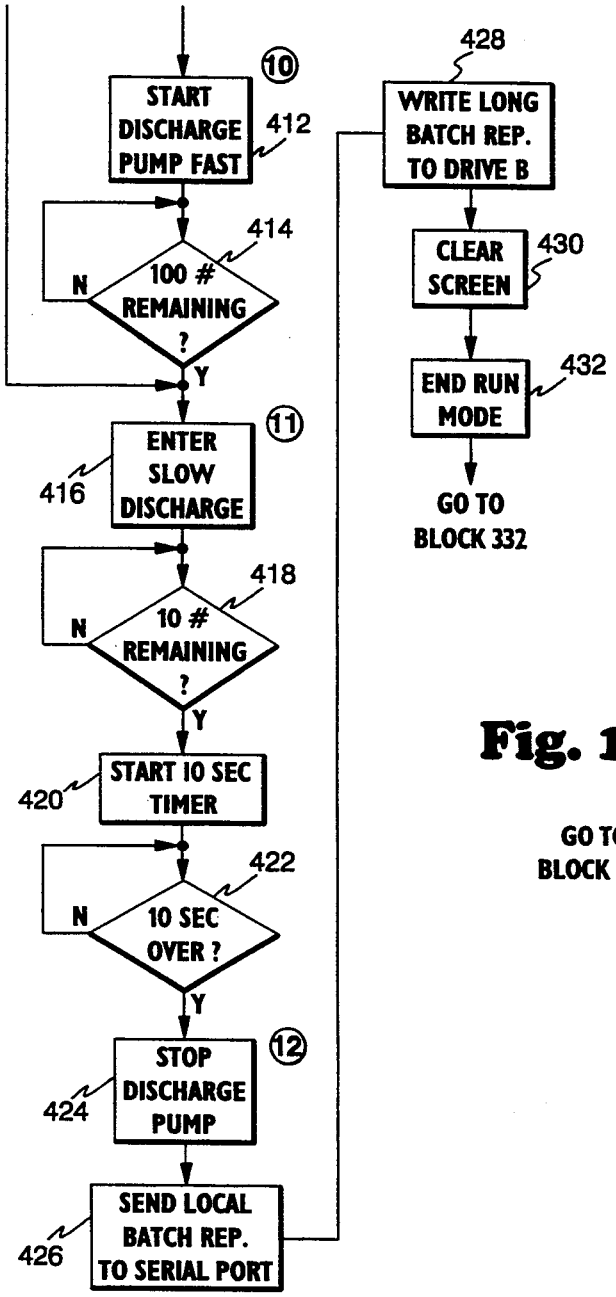
FIG. 17B illustrates a third portion of the flowchart describing the operation of the blending system.

The flowchart illustrated in FIG. 14, and generally designated by the reference numeral 320, represents the main routine of the system. The system is initially powered up in block 322. As illustrated in Row 1 of Table 316, the valve 202 is energized at this time. Next, in block 324, the computer 252 performs internal tests to insure that it and its peripherals are operating properly. If everything is operating properly, control transfers from the decision block 326 to block 328 where an operator loads the operating software onto the computer 252 from one of the disc drives 258. If not, control transfers from decision block 226 to block 330 where the process halts until the computer 252 can be repaired.

Many different data acquisition programs may form the basis for the operating software. However, the preferred software is a program called "Com-Trol" which is a general purpose industrial software package available from SDRG Controls, Inc. of Houston, Texas. Com-Trol is a general purpose computer control and monitoring program designed to run on IBM compatible personal computers. It will operate on almost any MS-DOS computer and it supports a wide variety of input/output hardware. Com-Trol includes a totally integrated programmable controller logic system (PLC logic), 64 channels of analog PID control, a security system, input/output board communication, a message generator, graphics capability, and database capability. The PLC logic system, for instance, is similar to any available PLC hardware system. However, due to its integration within Com-Trol, it has the advantage that it can communicate with all other portions of the Com-Trol package. The PLC logic is programmed very similarly to an Alan Bradley or GE programmable controller. To configure the system, the PLC label table is loaded prior to entering the logic programming so that description of contracts and coils automatically appear during programming. The PLC logic also provides timers and counters, math functions, and other special functions.

As will become apparent from the following discussion, the Com-Trol program, when used in conjunction with the system, controls the functioning of this system as set forth in this flowchart. Since the Com-Trol system would be quite easy for one skilled in the art to program after having had the advantage of studying the apparatus 10, the device 250, and this flowchart, details of the programming will not be discussed herein. One should merely realize that this data acquisition system, when programmed in accordance with the system parameters, i.e., to take into account the particulars of the apparatus 10, the device 250, and the control scheme set forth in the flowchart, is capable of receiving inputs from the apparatus 10, processing those inputs in the manner set forth in the flowchart, and outputting control signals to the apparatus 10.

Once this operating software is loaded, the computer begins to scan the keypad 270 in block 322 for operator inputs. As indicated in decision block 334, the function keys, F1, F2, F3, and F4, are of particular interest. As long as none of these keys has been pressed, the keypad 270 continues to be scanned. However, as soon as one of the keys is pressed, control transfers to a "subroutine" that is called in response to pressing that particular function key.

First, we will assume that the F1 key has been pressed as indicated in block 336. As indicated, when the F1 key is pressed, control transfers to block 350 in FIG. 17A. In the decision block 350, the computer 252 checks the signals input to it from the ground lines 160, 162, and 164. If any of these signals indicate that a line is not grounded properly, control transfers to block 330, and the operation is halted while the ground line is repaired. However, if the signals indicate that all of the ground lines 160, 162, and 164 are well grounded, control transfers to block 352 where the system enters the "RUN" mode.

In this mode, the operator inputs, in block 354, recipe numbers that indicate a particular type of chemical blend, an operator ID number, a batch number, an order number, a desired quantity, the serial number of a selected vat, and a package code, as illustrated in screen 305. For instance, in the preferred embodiment, there are 44 different recipes that are designated using the numbers 1 through 44. Thus, the system is capable of mixing 44 different types of chemical blends. Of course, fewer or more recipes may be added to serve any particular need. If the F4 key is pressed as indicated in block 342, control transfers to the block 450, in order to advance the screen being displayed on the monitor 254, and then control returns to the block 332. The operator may wish to view the recipes. Therefore, if the monitor is displaying the screen illustrated in FIG. 13A, a push of the F4 key displays the next sequential screen, the recipe screen 307, illustrated in FIG. 13B.

The operator's inputs are monitored in the decision block 356, and when the last number is input, control transfers to block 358. Here, with the recipe number entered, the software accesses an appropriate memory table or software routine that contains the particulars of the recipe selected. For instance, the operator may input that he desires a certain amount of a particular chemical blend that corresponds to recipe number 1. Recipe 1 is accessed in block 358 and, preferably, includes the various chemicals and the appropriate proportions to mix that particular chemical blend. Then, in block 360, the computer 252 calculates the required weight of each chemical given the proportions set forth in the stored recipe and given the desired weight input by the operator. For instance, recipe 1 illustrated in FIG. 13B may require 200 gallons of intermediate 1, 100 gallons of solvent 1, and 100 gallons of solvent 2, to produce 400 gallons of the blended chemical. However, if the operator enters 200 gallons under "quantity required" on the screen 305, the software will divide these values by two in order to produce 200 gallons of the proper chemical blend set forth in recipe 1.

Once the appropriate chemicals and their desired amounts have been identified, the appropriate charge pump 24, 26, or 27 is selected in block 362. As indicated in block 364, the computer prompts the operator to open the appropriate valve 212, 214, or 216 by delivering an appropriate message to the monitor 254. In block 366 the operator presses the "enter" key to open the appropriate valve. After the operator presses the "enter" key, the computer 252 outputs a signal via the digital output 264 to the appropriate solenoid valve, as set forth in block 368. As indicated by the encircled Number 2 next to block 368, Row 2 of Table 316 indicates that solenoid valves B, D, and E, are energized. Looking to Table 318, this corresponds to the pressure release valve 202, the dump valve 182, and the "down" position of three-position valve 212. Thus, in this situation, the charge pump 24 begins pumping chemicals from line 28 through line 20 at a high rate. During charging, the computer 252 monitors the signals output from the load cell 132 and delivered to the computer 252 via the analog input 266, as indicated in block 370. In block 372, the weight of the chemical is monitored to determine when less than a first predetermined amount, such as 200 pounds, of chemical is left to be charged. For instance, we can suppose that the recipe calls for 300 pounds of the chemical to be charged using the charge pump 24. Therefore, the first 100 pounds will charge at a fast rate. However, for the last 200 pounds, control transfers to block 374 where the charge rate is slowed using the two-speed circuit 196. As indicated by the encircled Number 3 next to block 374, Row 3 of Table 316 shows that the pressure release valve 202 is de-energized, the on-off valve 198 and the flow control valve 200 are energized, while the dump valve 182 and the three-position solenoid valve 212 remain energized.

The remaining 200 pounds of chemicals will continue to flow into the vat 50 until the remaining weight of the charging chemical reaches a second predetermined amount, referred to herein as the "preact" amount. It can be appreciated that even if the charge pump 24 immediately ceased operation when the computer 252 determined that the desired amount of chemical had just been charged into the vat 50, the system is susceptible to some finite amount of lag time between the time that the desired amount of chemical actually leaves the line 20 and the time that the computer 252 receives and processes the signal from the load cell 132. Furthermore, fluid flowing through the line 20 does not come to an immediate halt when the pump 24 stops pumping. Thus, the chemical being charged will overcharge. To calibrate the system for each charging chemical, a predetermined amount of the chemical, 100 pounds for instance, is charged into the vat 50 at the slow speed. If the chemical is not viscous, such as water, 105 pounds of the chemical may actually be charged into the vat 50 instead of the desired 100 pounds. Similarly, if the chemical is quite viscous, such as petroleum, 102 pounds of the chemical may actually be charged into the vat 50 instead of the desired 100 pounds. Regardless of what type of chemical is used, the illustrated system will probably overcharge by some small, but relatively consistent, amount. Therefore, each time a new chemical is introduced into a recipe stored in the system, the system is calibrated to determine the amount of chemical that is typically overcharged, and the preact amount is set to this value to compensate.

The system is calibrated at its slow charging speed, because the final portion of a charging chemical is charged at slow speed. Thus, each time the ratio between the "fast" charging speed and the "slow" charging speed changes, so as to change the "slow" charging speed, the system must be recalibrated. Taking the previous example, if the ratio was changed from 3:1 to 2:1, the slow speed would increase from 16.7 gallons/minute to 33.4 gallons/minute. At this increased rate, the amount of overcharge of each chemical would increase. Therefore, the system would require manual recalibration, as set forth above. However, it is also contemplated that the computer-controlled system could include a look-up table or graph for each type of chemical. This table would contain preact amounts for various charging speeds, preferably covering the range of charging speeds possible in the system. The table, or associated software, could also be used to adjust the preact amount for various temperature or humidity conditions.

Taking the examples listed above, if water is typically overcharged by 5 pounds, the system will automatically subtract this "preact" amount from the desired amount. Thus, if a recipe calls for 100 pounds of water, when the system determines that 95 pounds of water have been charged, block 376 transfers control to block 378 to stop the charging. Similarly, the preact amount for the petroleum would be 2 pounds. Therefore, if 100 pounds of petroleum is desired for the particular recipe, 98 pounds of petroleum would be charged before the system stops charging. It should be understood that this offset or "preact" amount may not be needed in a system that terminates fluid flow at a point in the lines 20, 22, and 25 near the vat 50. In that case, the amount compared in decision block 376 would be zero so that the system would stop charging when the system determined that the desired amount had been charged.

Referring now to Row 4 in Table 316, once the system determines that charging should stop, the system re-energizes the pilot valve 202 and de-energizes the on-off valve 198, the flow control valve 200, the dump valve 182, and the three-position valve 212. Control then transfers to block 380 where a 10 second timer is started. As indicated in Row 5 of Table 316, the dump valve 182 is re-energized, and the three-position valve 212 is energized into its "up" position to provide a cross flow as previously described. This action reverses the charge pump 24 in the "fast" mode as set forth in block 382. Thus, the pump 24 reverses and clears out the line 20 until the timer expires, as set forth in decision block 384.

After the line 20 has been evacuated, control transfers to block 386 where the charge pump 24 is stopped. As set forth in Row 6 of Table 316, it can be seen that the three-position valve 212 is de-energized, along with the dump valve 182. Once this is accomplished, the computer 252 sends a prompt to the monitor 254 which tells the operator to close the valve 212, as set forth in block 388. After the operator presses "enter", in block 390, control transfers to the decision block 392 to determine whether the chemical just charged is the last chemical required for the selected recipe, or whether another chemical must be charged. If it is not the last chemical, then control transfers to block 364 where the system will prompt the operator to open the appropriate valve 212, 214, or 216. Since each charge pump 24, 26, and 27 is dedicated to a particular type of chemical, as previously described, it is likely that only one pump will be used to charge the various chemicals in each recipe, because these chemicals will all probably fall within the particular chemical type dedicated to the selected pump. In this example, the computer 252 will likely prompt the operator to re-energize the valve 212. However, it should be understood that the operator will not initiate the valve opening until the appropriate line 28A, 28B, or 28C has been connected to the appropriate chemical container.

The system continues to run between block 364 and block 392 until all of the chemicals required for the recipe have been charged into the vat 50. When the last chemical has been charged, control transfers to block 394 where the mixer motor 161 is started. As indicated in Row 7 of Table 316, the pilot valve 202 and the dump valve 182 are energized at this time. Control then transfers to the decision block 396 to determine the amount of chemicals in the vat 50. If there are less than a predetermined amount of chemicals, such as 200 gallons, in the vat 50, control transfers to block 398 where the mixer motor 161 is set to a slow mixinq speed. As indicated in Row 8 of Table 316, the on-off valve 198 is activated, along with the flow control valve 200. The dump valve 182 and the mixer valve 220 remain activated, and the pilot valve 202 is deactivated. Control then transfers to the block 400 where a timer is set to determine the mixing time. Of course, if there are over 200 gallons in the vat 50, control transfers directly to block 400 and bypasses the block 398, thus setting the mixer motor 161 at a fast mixing speed. As indicated in the decision block 402, when the timer that was set in block 400 expires, control transfers to block 404 where the mixer is stopped. As indicated in Row 9 of Table 316, the valves 198, 200, 182, and 220 are de-energized, and the pilot valve 202 is re-energized.

The system then prompts the operator, via the monitor 254, to discharge the chemicals from the vat 50. When the operator presses "enter" in block 408, control transfers to the decision block 410 where the system determines the discharge rate of the discharge pump 150. If the blended chemicals are to be put in small containers, such as 55 gallon drums, control transfers to block 416 where the system enters the slow discharge mode. As indicated in Row 11 of Table 316, the valves 198, 200, and 182 are energized, and valve 202 is de-energized. Also, valve 218 is energized into its "down" position. However, if the blended chemicals are to be discharged into a large container, the decision block 410 transfers control to block 412 where the system enters a fast discharge mode. As indicated in Row 10 of Table 316, the valves 202 and 182 are energized, and the valve 218 is energized in its "down" position. The system remains in the fast discharge mode until the system determines, in block 414, that a predetermined amount of chemicals, such as 100 pounds, remain in the vat 50. Then, the system enters the slow discharge mode in block 416, as previously described. The system continues to monitor the amount of chemicals remaining in the vat 50, as indicated in the decision block 418. When only 10 pounds of chemicals remain in the vat 50, control transfers to block 420 where a 10 second timer is started. When the 10 seconds expires, the decision block 422 transfers control to block 424 where the discharge pump 150 is stopped. As indicated in Row 12 of the Table 316, the valves 198, 200, 182, and 218 are de-energized, and the valve 202 is re-energized.

When the system has completely discharged the chemicals from the vat 50 a local batch report is sent to the serial printer 260, in block 426, and a detailed batch report is sent to the disc drive 258, as indicated in block 428. The local batch report preferably contains information such as product description, operator identification, batch number, order number, quantity, date and time. The detailed batch report preferably contains this information plus desired and actual ingredient weights and amounts, net weight and amount, mixing speed, total processing time, and other descriptive or packaging information. Then the system clears the monitor 254, in block 430, and ends the RUN mode in block 432. When the RUN mode ends, control transfers back to block 332.

An average chemical blend, or recipe, uses about three intermediates or solvents, and produces about 400 gallons of the blended chemical. Due to the speed at which these chemicals may be charged, the speed at which the system can clean itself, and the speed at which containers may be connected to the system, the average charging time for 400 gallons of a chemical blended using three intermediates or solvents is less than 30 minutes. Furthermore, due to the factors listed above and due to the ease at which the vats are removed or the chemicals discharged therefrom, a second 400 gallon batch Of a chemical blended using three intermediates or solvents may be completed within the next 30 minutes. Thus, it can be seen that this system can produce high quality chemical blends in a rapid fashion.

Anytime the operator wishes to interrupt the system when it is in the RUN mode, the operator can press the F2 key as indicated in block 338. Actuation of the F2 key transfers control to the decision block 434 illustrated in FIG. 18. If the system is not in the RUN mode, control transfers to block 436 where nothing happens, and then transfers back to block 332 to await the next input from the operator. However, if the system is in the RUN mode, control transfers to block 438 where the RUN mode is interrupted. Then, the system monitors the F1 key in the decision block 440. As long as the F1 key is not pressed again, the keypad continues to be scanned in block 332. However, if the F1 key is pressed again, control transfers to block 442 where the RUN mode continues from where it was interrupted. In other words, if the operator interrupted the RUN mode at block 394, control would transfer back to block 394 where the mixer would be started.

Figure 19:
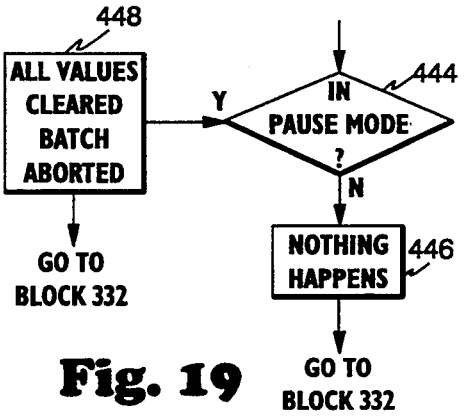
FIG. 19 illustrates a fifth portion of the flowchart describing the operation of the blending system.
Figure 18:
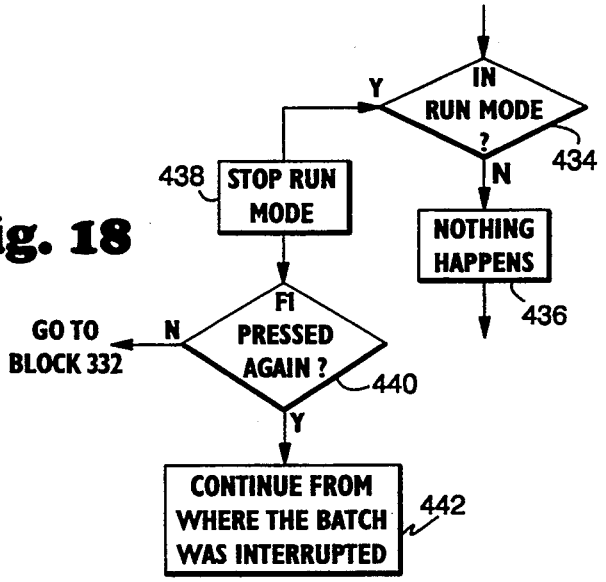
FIG. 18 illustrates a fourth portion of the flowchart describing the operation of the blending system.
Figure 20:
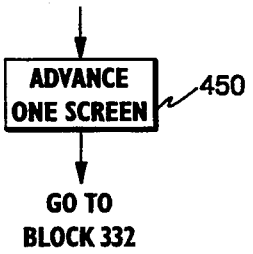
FIG. 20 illustrates a sixth portion of the flowchart describing the operation of the blending system.

As indicated above, pressing the F2 key merely pauses the RUN mode, and, therefore, the system essentially enters a PAUSE mode. If the F3 key is pressed, as indicated in block 340, control transfers to the decision block 444 as illustrated in FIG. 19. If the system is not in the PAUSE mode, control transfers to the block 446, where nothing happens, and then control transfers back to the block 332. However, if the system is in the PAUSE mode, control transfers to the block 448, where all of the values are cleared and the RUN mode is aborted. Then, control transfers back to the block 332. Therefore, to prematurely end the RUN mode, the F2 key must be pressed first, and then the F3 key must be pressed.

In view of the above description, it can be seen that the use of the system permits a much wider range of economical products to be produced and delivered to customer sites than conventional techniques. The system is small, portable, and conducive to placement at remote sites, such as a customer's location. Thus, chemical blends produced by this system cost less than conventional products because they are produced closer to the customers site. This decreases or eliminates costs associated with conventional procedures, such as freight costs, container costs, hazardous waste disposal costs, finished product inventory costs, and dog inventory costs. The disclosed process also decreases the cost of the blended chemical by improving the quality of the blended chemical. Furthermore, the system operates in a prevention mode, instead of an appraisal mode. In other words, the system offers high repeatability, which is statistically proven, so that every chemical blend produced need not be tested. According to industry-accepted ratings, the system disclosed herein exhibits a process capability of "3+." Thus, the cost associated with inspecting each batch of product and with reworking undesirable blends is greatly reduced.

The system produces several products from a few intermediates and solvents. By consolidating the product line to a few reacted intermediates, only the intermediates need be inventorled, thus lowering the number of inventoried products. For instance, twelve types of corrosion inhibitors may be made by different blends of only three intermediates. Thus, instead of keeping an inventory of the twelve finished products, the inventory need only consist of the three intermediates. Moreover, since only the intermediates are inventoried, the discontinued use of certain blended chemicals will not result in economic loss and the problem of waste disposal. For instance, if a customer decided that it no longer required one of the twelve finished products, in the past, any amount of that product in inventory could no longer be sold and would require disposal. However, by using the system, since no finished products are kept in inventory, the discontinued use of a particular finished product would not adversely effect profitability.

Because the system typically uses only a few intermediates and solvents, offers high repeatability, and quickly cleans itself, it may produce small quantities of bulk product rapidly and efficiently. Thus, the lag time between the receipt of an order and the shipment of the product ordered is greatly reduced. The capability of shipping small bulk quantities of blended chemicals is important because customers increasingly want less inventory on hand to reduce their cost. The system provides this "just-in-time" small bulk delivery capability.

The system is capable of tracking inventory on both raw materials and finished products. In addition, the system generates invoices immediately after each batch is produced. By automating these functions, the system further reduces the possibility of operator error and increases the speed at which these functions are performed.

Since the system preferably includes a remote control system, engineers can electronically transmit new chemical formulas and procedures to remotely located blending units. Once an engineer has developed a new formula that a particular customer desires, it can be immediately downloaded into the computer. Thus, the customer need wait only days rather than weeks to receive a custom blended chemical. Moreover, due to the flexibility of the computer control, the recipes can be formulated to reflect specific regional or environmental needs.

We claim:

1. An apparatus for blending chemicals, said apparatus comprising:

a blending vat;

a mixer for blending chemicals in said blending vat;

a pump being coupled to said blending vat by an output line, said pump having an input line being adapted to couple to each of a plurality of sources of chemicals, said pump being operable in a forward direction and a reverse direction and having a high speed and a low speed in said forward direction; and a control system being coupled to said pump for activating said pump in said low speed and said high speed in said forward direction and in said reverse direction.

2. The apparatus, as set forth in claim 1, further comprising a transportable skid being coupled to and carrying said blending vat, said mixer, said pump, and said control system.

3. The apparatus, as set forth in claim 1, further comprising a truck having a bed, said bed being coupled to and carrying said blending vat, said mixer, said pump, and said control system.

4. The apparatus, as set forth in claim 1, wherein said control system comprises:

a two-speed control and a direction control being coupled to said pump, said two-speed control controlling said speed of said pump and said direction control controlling said direction of said pump.

5. The apparatus, as set forth in claim 4, wherein said control system further comprises:

a computer being electrically coupled to said two-speed control and to said direction control for automatically controlling said speed and direction of said pump.

6. The apparatus, as set forth in claim 5, wherein said computer stores a plurality of recipes, each of said recipes specifying chemicals and relative proportions of said chemicals comprising a respective chemical blend and wherein said computer automatically controls said two-speed control and said direction control according to a selected one of said plurality of recipes.

7. The apparatus, as set forth in claim 6, wherein said mixer is vertically moveable between a raised position above said blending vat and a lowered position within said blending vat.

8. The apparatus, as set forth in claim 7, wherein said control system comprises:

a mixer control being coupled to said mixer and to said computer, said mixer control controlling movement of said mixer between said raised and lowered positions.

9. The apparatus, as set forth in claim 5, wherein said control system further comprises:

a load cell being coupled to said blending vat, said load cell delivering a signal to said computer, said signal having an attribute correlative to the weight of a chemical in said bleeding vat, wherein said computer switches said pump from said high speed to said low speed in response to said attribute to said signal being correlative to a first predetermined weight and switches said pump from said slow speed to said reverse direction in response to said attribute of said signal being correlative to a second predetermined weight.

10. The apparatus, as set forth in claim 1, further comprising:

a discharge pump being coupled to said blending vat for removing blended chemicals from said vat.

* * * * *

UNITED STATES PATENT AND TRADEMARK OFFICE

CERTIFICATE OF CORRECTION

PATENT NO. : 5,340,210

DATED : August 23, 1994

INVENTOR(S) : Mayur Patel, Michael T. Phillips, Gary L. Cooper, and Daniel Emmons It is certified that error appears in the above-indentified patent and that said Letters Patent is hereby corrected as shown below:

Column 10, line 17, after "channels" insert --.--.

Column 20, line 8, "bleeding" should be --blending--.

Signed and Sealed this

Eighth Day of November, 1994

Bruce Lehman

*Attest:*

BRUCE LEHMAN

*Attesting Officer*

*Commissioner of Patents and Trademarks*